United States Patent [19]

Homma

[11] Patent Number: 4,488,661

[45] Date of Patent: Dec. 18, 1984

[54] COMPOSITE PACKING CONTAINER

[75] Inventor: Yoshihiro Homma, Urawa, Japan

[73] Assignee: Hokkai Seikan Kabushiki Kaisha, Tokyo, Japan

[21] Appl. No.: 322,274

[22] Filed: Nov. 17, 1981

[30] Foreign Application Priority Data

Nov. 26, 1980 [JP] Japan ..... 55-168341
Aug. 10, 1981 [JP] Japan ..... 56-117685

[51] Int. Cl.[3] ..... B65D 90/04

[52] U.S. Cl. ..... 220/462; 206/621; 220/465; 229/7 R

[58] Field of Search ..... 220/462, 463, 403, 400, 220/415, 446, 468, 465, 460; 206/620, 621, 622, 625; 229/57, 58, 62, 59; 229/61, 17 R, 7 R; 222/105, 569

[56] References Cited

U.S. PATENT DOCUMENTS

| | | | |
|---|---|---|---|
| 2,338,604 | 1/1944 | Silveyra | 229/7 R |
| 3,412,919 | 11/1968 | Cain | 229/7 R |
| 3,468,451 | 9/1969 | Coleman | 220/465 |
| 3,572,017 | 3/1971 | Terzuoli | 229/58 |
| 3,741,463 | 6/1973 | Young et al. | 229/17 R |
| 4,174,051 | 11/1979 | Edwards et al. | 220/465 |

*Primary Examiner*—Stephen Marcus
*Assistant Examiner*—Robert Petrik
*Attorney, Agent, or Firm*—Birch, Stewart, Kolasch & Birch

[57] ABSTRACT

A composite packing container which comprises an inner container including a ring having an opening disposed therein the ring is provided with an inner circumferential edge projecting downwardly therefrom. A closure member is detachably mounted in the opening for closing the same. The inner container is made of a synthetic resinous film which is, at its bottom surface portion attached to the whole circumference of the lower end portion of the inner circumferential edge of the ring, with its top opening portion being open in the downward direction. An outer container which includes a box arranged to receive the inner container. A pair of opposing inner flaps are connected to an upper open peripheral edge of the box and arranged to be inserted into a gap formed between the frame member and the bottom surface portion for supporting the frame member from below. A pair of opposing outer flaps are arranged to cover the frame member which is closed by the closure member and brought in engagement with said inner flaps. Perforated lines are cut in such regions of the outer flaps so as to conform to the shape of the closure member at the time of sealing the outer flaps and the inner flaps and the outer flaps, are adhered together at their mutually facing inner surfaces.

8 Claims, 21 Drawing Figures

FIG. 12
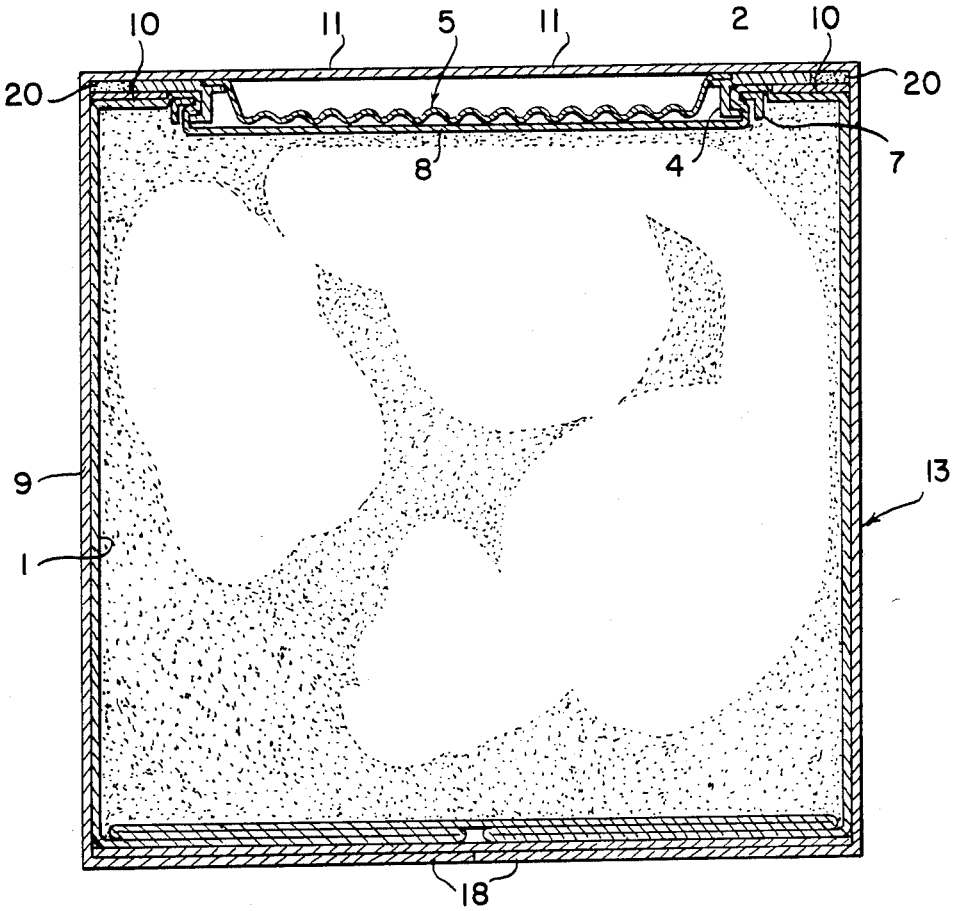
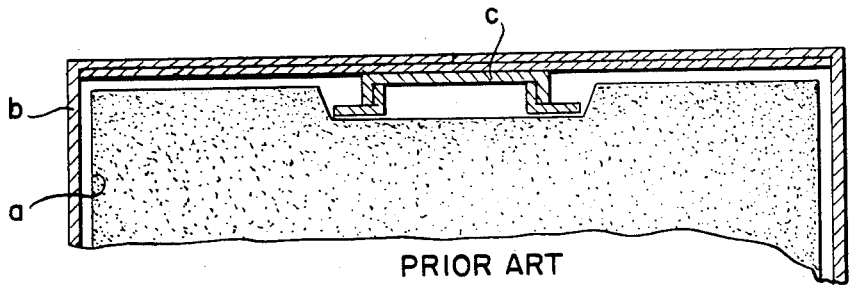
PRIOR ART
FIG. 14

COMPOSITE PACKING CONTAINER

BACKGROUND AND SUMMARY OF THE INVENTION

The present invention relates to a composite packing container of the type wherein a liquid or solid material such as powder or the like, is placed in an inner bag made of a synthetic resinous film material which in turn is surrounded by an outer container made of paper board such as corrugated cardboard or the like.

As to conventional composite packing containers of this kind, there has heretofore been used one such type of bag made of a synthetic resinous film adapted to contain a liquid or the like and mounted in an outer container made of paper board, with the bag being provided with a pouring mouth.

With this type of packing container, as shown in FIG. 14, the synthetic resinous film bag is provided with a pouring mouth c attached to the top surface portion thereof. The pouring mouth c is mounted in and covered by the outer container b at the time of packing of the goods, and consequently the pouring mouth c is compressed into the bag a or pressed against the bag a. Accordingly, there is created the problem that when a powder, a liquid or the like contained in the bag a is moved by vibrations or shocks or the like during the conveyance thereof, such portion of the bag a in the area of the pouring mouth c experiences repeated bending movements and friction with the outer container b, and as a result there is created therein pin holes or other defects which cause leakage of the liquid or the like. Additionally, when it is desired to extend the pouring mouth c and position it outside the outer container b, if the bag a is not completely filled with liquid or the like, the pouring mouth c will shift within the outer container b. This results in a problem wherein before the pouring mouth c may be extended it must first be located. For avoiding these defects, a container has been proposed such that only the pouring mouth c of the bag is positioned outside the outer container b. With this arrangement, however, difficulties are experienced in storing or conveying a plurality of containers of this type, when they are stacked one upon the other, because the pouring mouth c protrudes from the outer surface of the container b.

Accordingly, an object of the present invention is to provide a composite packing container wherein the foregoing defects can be eliminated by providing a simple arrangement wherein an inner container is inserted in an outer container, and a commodity such as a liquid, powder or the like is readily charged and packed into the container.

Another object of the present invention is to provide a container for storing or conveying a plurality of containers in a stacked state.

A further object of the present invention is to provide a container for readily discharging packed good. After opening of the container, it may be closed again so that it can be used regularly.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention comprises an inner container 1 a ring 2 having an opening 3 and an inner circumferential edge 4 projecting downwardly therefrom. A closure member 5 is detachably mounted in the opening 3 for closing the same. The inner container made of a synthetic resinous film is, at its bottom surface portion 8, attached to the entire circumference of the lower end portion of the inner circumferential edge 4 of the ring 2, with its top opened end portion extending in the downward direction. The paper board outer container 13 comprises a box 9 arranged to receive the inner container with a pair of inner flaps 10, 10 connected to an upper open peripheral edge of the box 9 and arranged to be inserted in a gap formed between the ring 2 and the bottom surface portion 8 for supporting the ring 2 from below. A pair of outer flaps 11, 11 are arranged to cover the ring 2 which is closed by the closure member 5 and brought in engagement with the inner flaps 10, 10. Perforated lines 12, 12 are cut in the regions of the outer flaps 11, 11 so as to conform to the shape of the closure member 5 which to face the closure member 5 at the time of closing the outer flaps 11, 11, and the inner flaps 10, 10. The outer flaps 11, 11 are adhered together at their mutually facing inner surfaces.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 12 is a sectional view taken along line XII—XII of FIG. 11;

FIG. 14 is a sectional side view of a conventional example.

DETAILED DESCRIPTION OF THE INVENTION

The present invention will now be explained in more detail with reference to FIGS. 1 to 13.

Figure 1:
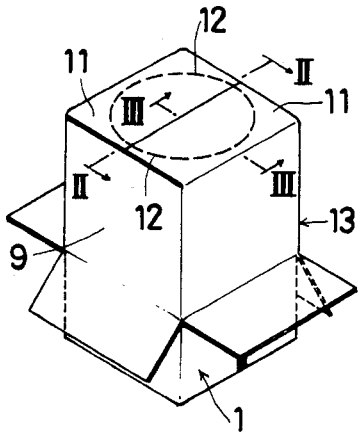
FIG. 1 is a perspective view of one exemplified composite type container of the present invention.
Figure 4:
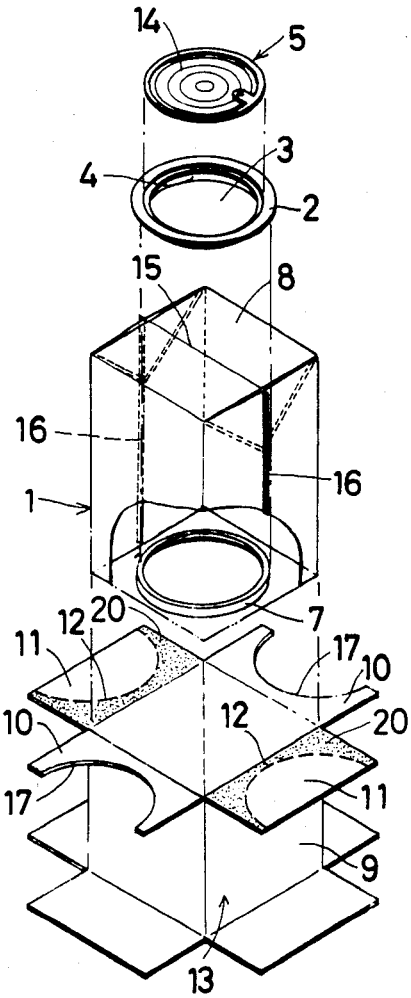
FIG. 4 is an exploded perspective view of the container shown in FIG. 1.

As clearly shown in FIG. 1, the present invention comprises a composite container in which an inner container 1 is mounted in and fixed to an outer container 13. As clearly shown in FIG. 4, one example thereof comprises an inner container 1 including a ring 2, a closure member 5 and an engageable fastening ring 7 for positioning within an outer container 13. As clearly shown in FIGS. 4 and 7, the ring 2 is formed of a synthetic resinous material, and is provided integrally with an inner circumferential edge 4 which projects downwards from the periphery of an opening 3 disposed therein. A step portion 4*a* is formed on the outer periphery of the inner circumferential edge 4. The upper end of the inner circumferential edge 4 of the ring 2 is so arranged as to be lower in height than the upper end of the ring 2 by a distance corresponding to the thickness of the peripheral edge of the closure member 5. When the closure member 5 is mounted in the ring 2, the upper surface of the closure member 5 does not project upwards from the upper surface of the ring 2. FIG. 4 is an exploded view of the components which form the composite container according to the present invention. In constructing the composite container, the fastening ring 7, as illustrated in FIG. 4, is inserted through the open end of the inner container 1 and is mounted on the ring 2 to retain the bottom surface 8 of the bag 6, as illustrated in FIGS. 2, 3, 8 and 12.

The closure member 5 is made of a synthetic resinous material similarly to the material of the ring 2, and is in the form of a disc. Circular beads 14 are concentrically formed on the central disc area thereof. The closure member 5 can be removed when the closure member 5 is formed from a thin soft synthetic resinous material and is deflected.

The bag 6 is made of a folded sheet to form an envelope, and the width of the folded sheet is larger than the diameter of the ring 2. A middle surface bottom portion 63 thereof is folded inwardly at its center transversal fold 15 and side edges 16, 16 of both side surfaces are sealed together by heat fusion, and the resultant bag is expanded to form the bottom surface portion 8.

Figure 5A:
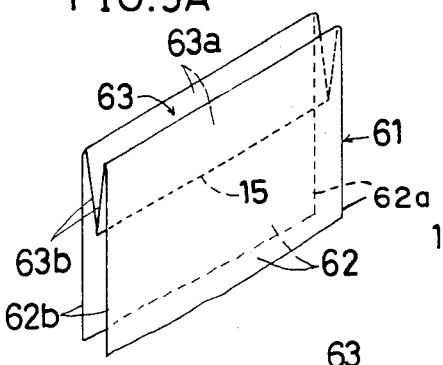
FIGS. 5A–5C are perspective views showing a manufacturing process of the bag of FIG. 4.
Figure 5B:
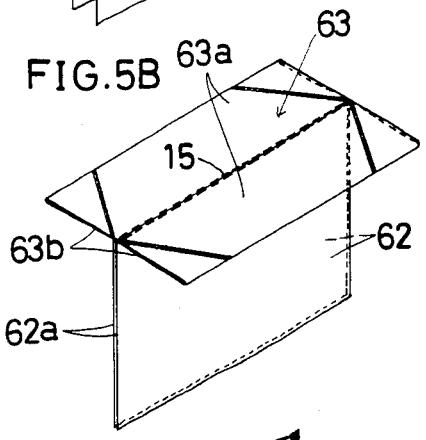
Figure 5C:
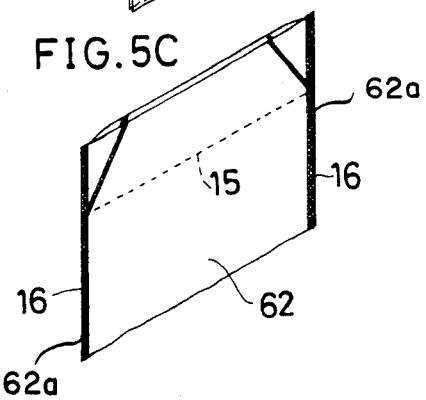

A process for forming the bottom surface portion 8 of the bag 6 will be explained more in detail as follows:

A sheet of synthetic resinous film 61 is foled into an envelope having a pair of opposite side surface portions 62, 62 and a middle surface bottom portion 63. The middle surface bottom portion 63 is further folded inwardly to form a fold 15 at a central transversal line and mutually facing right and left parts 63*a* and 63*a* thereof, as shown in FIG. 5A. As shown in FIG. 5B, the facing parts 63*a*, 63*a* of the folded middle surface bottom portion 63 are spread outwardly, and portions of the facing parts 63*a*, 63*a* and portions of side edges 62*a*, 62*a* of the side surface portions 62, 62 that overlap the parts 63*a*, 63*a* are fused together in the form of a V in both end regions of the spread middle surface bottom portion 63. Thereafter, as shown in FIG. 5C, the facing parts 63*a*, 63*a* of the spread middle surface bottom portion 63 are turned inwardly about the fold 15 and placed together, and the respective opposite side edges 62*a*, 62*a* and 62*a*, 62*a* of the opposite side surface portions 62, 62 as well as both side edges 63*b*, 63*b* of the middle surface bottom portion 63 are fused together to form the two sealed side edges 16, 16 of the bag 6. Thereafter, the bag 6 is expanded to form a square bottom surface portion 8 of the bag 6, as shown in FIG. 4.

Figure 6A:
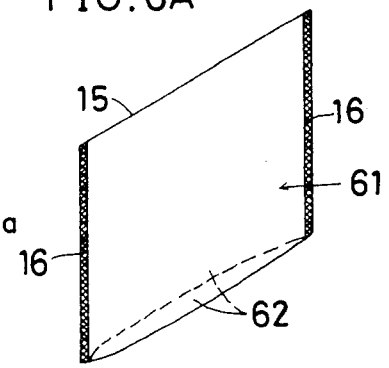
FIGS. 6A–6C are perspective views showing a modified example of the manufacturing process of the bag, utilized in the present invention.
Figure 6B:
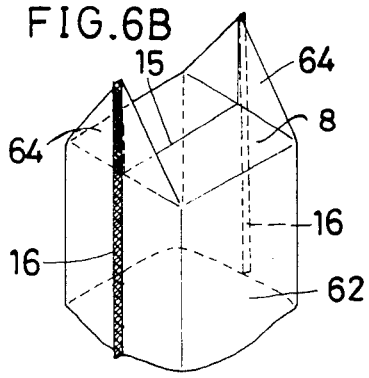
Figure 6C:
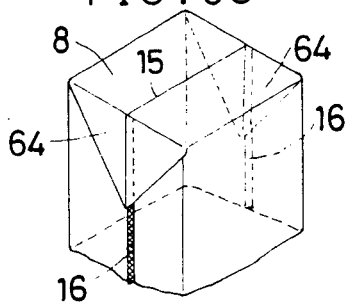
Figure 7:
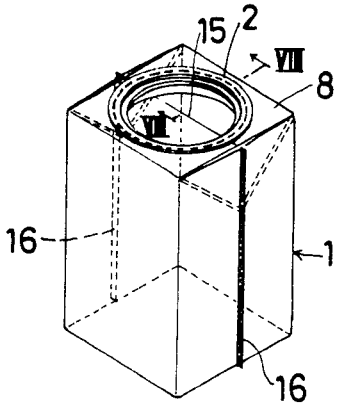
FIG. 7 is a perspective view of an inner container in an assembled state.

The process of forming the bottom surface portion 8 of the bag 6 as shown in FIGS. 4 and 5 can be modified as follows. As shown in FIG. 6A, a sheet of synthetic resinous film is folded into two and both side edges thereof are fused together to form the heat-sealed side edges 16, 16. The bag 6 thus formed is so expanded as to form a flat square bottom surface portion 8 as shown in FIG. 6B, and the resultant two triangular corner portions 64, 64 thereof are folded downwardly against the side surface portions 62, 62 as shown in FIG. 6C.

Figure 8:
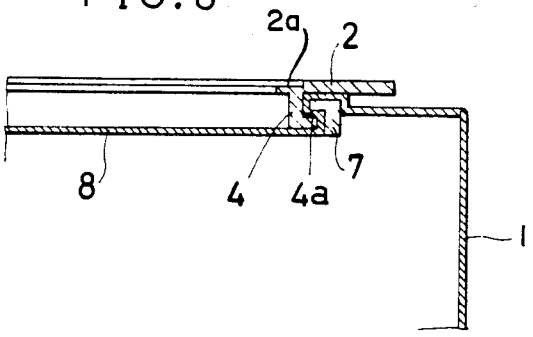
FIG. 8 is a sectional view taken along line VIII—VIII of FIG. 7.

Next, for constructing the inner container 1, as shown in FIGS. 4 and 8, the ring 2 is brought into contact with the bottom surface portion 8 of the bag 6, and the fastening ring 7 is mounted on and engaged with the annular step portion 4*a* formed on the outer surface of the inner circumferential edge 4 of the ring 2, from inside of the bag 6. Thus, the bottom surface portion 8 of the bag 6 is tightly fastened to the ring 2 and at the same time the opening 3 of the ring 2 is tightly closed by the bottom surface portion 8. The ring 2 includes a recess 2*a* for receiving the closure member 5.

Figure 3:
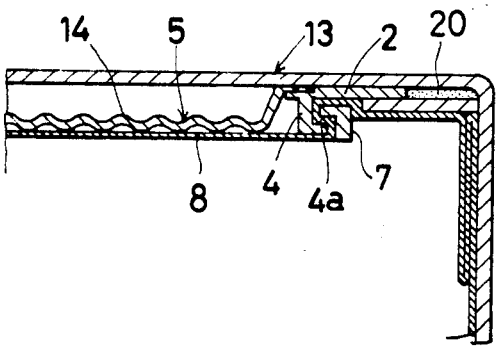
FIG. 3 is a sectional view taken along line III—III of FIG. 1.
Figure 2:
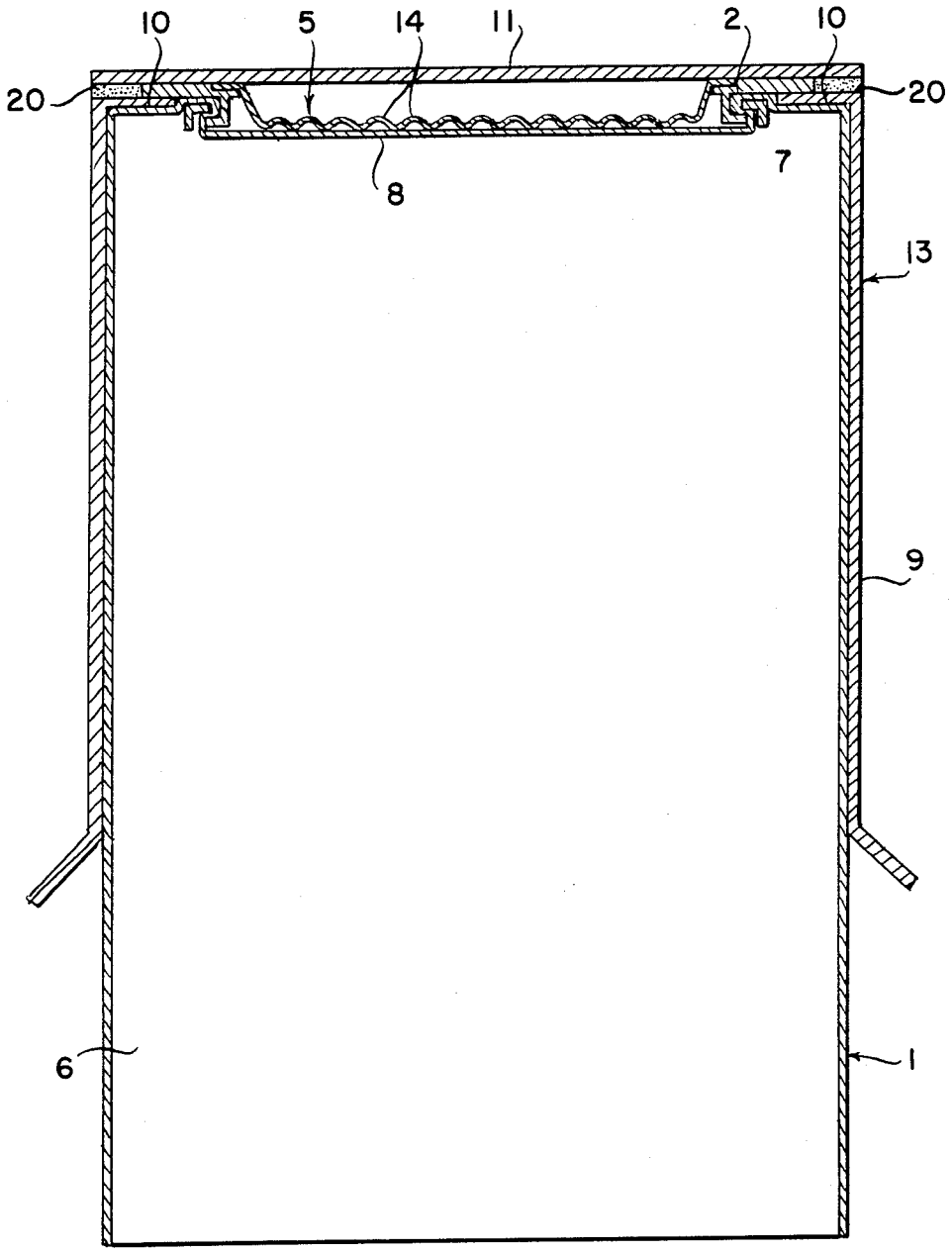
FIG. 2 is a sectional view taken along line II—II of FIG. 1.
Figure 9:
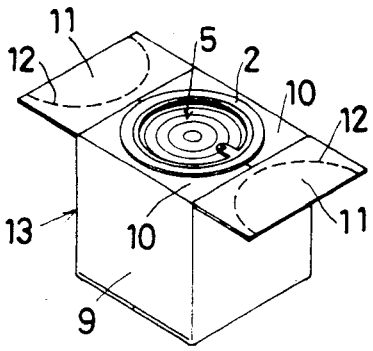
FIG. 9 is a perspective view of the inner container mounted in an outer container.

The outer container 13 has a usual rectangular form and is made of corrugated cardboard, and the box 9, that is, the side peripheral frame is adapted to snuggly receive the foregoing inner container 1. A pair of opposite inner flaps 10, 10 connected to the upper, open periphery of the container are so formed that their forward edges are shaped into semicircular arcs 17, 17 as shown in FIG. 4. As shown in FIGS. 2, 3 and 9, the opposite inner flaps 10, 10 are inserted into a gap formed between the ring 2 of the inner container 1 and the bottom surface portion 8 of the bag 6, so that the inner container 1 is supported by the outer container 13.

In addition, a pair of opposite outer flaps 11, 11 connected to the remaining two opposite side edges of the upper open periphery of the outer container 13 are so formed as to be brought into abutment with each other at the center portion of the opening of the ring 2 sufficiently to cover the ring 2 and the closure member 5 which is positioned after the ring 2 of the inner container 1 is supported by the inner flaps 10, 10, as shown in FIGS. 3 and 9. In addition the outer flaps 11, 11 are applied with respective semi-circular perforated lines 12, 12 which are so made therein as to extend along the circular shape of the closure member 5 positioned below the outer flaps 11, 11 when the outer flaps 11, 11 are closed together to cover the inner flaps 10, 10. The outer flaps 11, 11 and the inner flaps 10, 10 are adhered together at their mutually facing inner surfaces.

Accordingly, as shown in FIGS. 2 and 3, the inner container 1 is positioned in the outer container 13, the ring 2 of the inner container 1 is in engagement with the inner flaps 10, 10 of the outer container 13, and the inner and outer flaps 10, 10, 11, 11 are integral one with the other by an adhesive agent 20, so that the ring 2 is held firmly therebetween and thus is securely fixed to the outer container 13.

Figure 11:
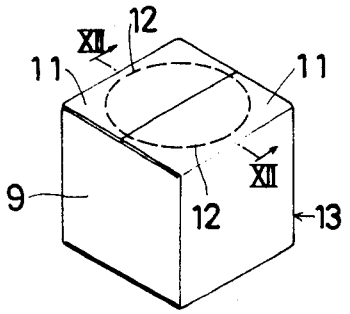
FIG. 11 is a perspective view showing a packed condition after supplying the contents into the container.
Figure 10A:
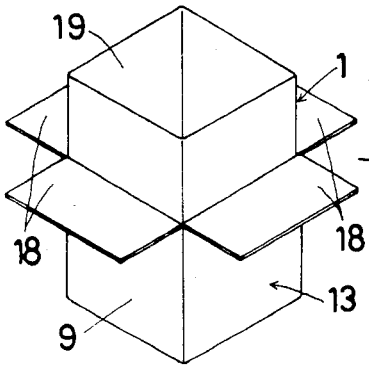
FIGS. 10A–10D are perspective views showing a method for supplying goods into the container.
Figure 10B:
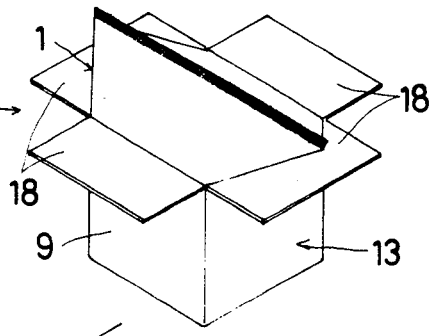
Figure 10C:
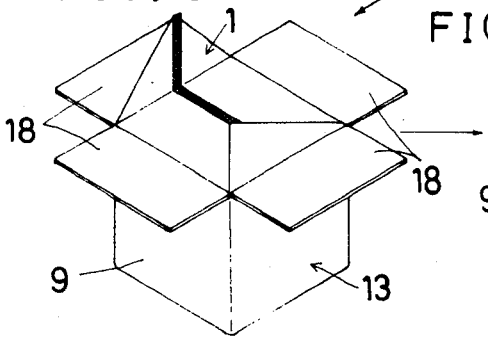
Figure 10D:
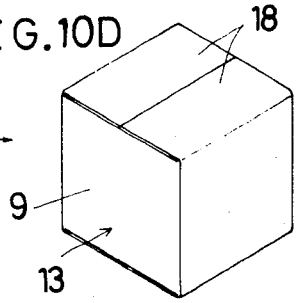

When any goods such as liquid or the like are intended to be charged into the inner container 1, the outer container 13 containing the inner container 1 therein is turned upside down as shown in FIG. 10A, and the goods are charged therein from an opening 19 of the inner container 1 surrounded by lower flaps 18 of the outer container 13. Thereafter the opening of the inner container 1 is sealed by fusion adhesion as shown in FIG. 10B, and the heat-sealed portion of the inner container 1 is folded inwardly to become a square flat surface portion, as shown in FIG. 10C, and then the inner and outer flaps 18 are closed together in order to cover the square surface portion and are adhered together to complete the packing as shown in FIG. 10D and FIG. 11.

Figure 13:
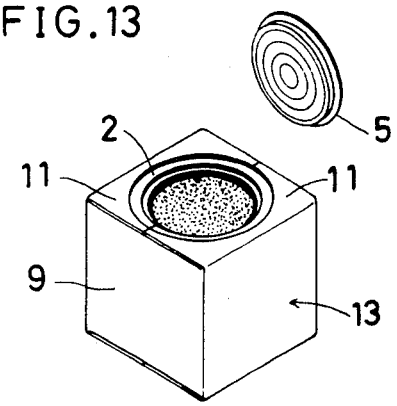
FIG. 13 is a perspective view showing an opened state of the container for dispensing the goods therefrom.

For discharging the packed goods, the portions encircled by the perforated lines 12, 12 in the outer flaps 11, 11 of the outer container 13 are torn off to expose the closure member 5. The closure member 5 is taken off and the bottom surface portion 8 of the bag 6 closing the opening 3 is torn or cut off, as shown in FIG. 13, so that the goods contained therein can be dispensed. Thereafter the inner container 1 is closed again by mounting the closure member 5 in the opening 3. Even when the same is covered or uncovered repeatedly by the closure member 5, the ring 2 is firmly fixed to the outer container 13, so that closing and opening of the closure member 5 can be facilitated.

Accordingly, as the goods are taken out of the container, the amount thereof in the bag 6 is decreased, the ring 2 is held between the inner and outer flaps 10, 10, 11, 11 so that the ring 2 is always kept in its fixed position and is never shifted or lowered and there is no trouble in taking out the goods contained therein.

The foregoing examples have shown that the foregoing folded sheet and the bag-shaped members which have no square bottom surface are used for forming the inner container 1, but the same object of the present invention can be achieved also by using, as the inner container 1, any bag-shaped member of which the bottom portion is already formed into a square bottom surface portion. However, when the foregoing members are used, the inner container 1 can be produced at a lower price. The foregoing examples have shown that the ring 2 is fixed to the bottom surface portion 8 of the inner container 1 by the fastening ring 7 in the construction of the inner container 1. However, such a modification can be considered wherein only the ring 2 previously closed by the closure member 5 is held between the inner flaps 10, 10 and the outer flaps 11, 11 of the outer container 13 and thereafter the bottom surface portion 8 of the inner container 1 is brought into contact with the lower end of the inner circumferential edge 4 of the ring 2 through the opposite opening 19 of the inner container 1 in the outer container 13, and then the fastening ring 7 is mounted on the step portion 4*a* of the inner circumferential edge 4 so as to fix the ring 2 to the bag 6.

In the foregoing examples, the ring 2 is detachably fixed to the inner container 1 by the fastening ring 7, but this object can also be achieved by causing the ring 2 to be directly adhered to the bag 6 by fusion adhesion or by an adhesive agent.

Thus, according to the present invention, the ring 2 of the inner container 1 is supported by the inner flaps 10, 10 of the outer container 13 and is covered by the outer flaps 11, 11, so as to be held between the flaps 10, 10 and 11, 11. Thus the ring 2 of the inner container 1 never moves even when the goods contained therein are caused to vibrate due to shocks created during the conveyance of the container. Accordingly, there is no fear that the surrounding region of the inner container 1 adjacent to the ring 2 might be subjected to repeated bending actions causing pin holes to be created therein. Additionally, since the top surface of the outer container 13 is flat, even after the goods are packed, it is simple and convenient to store and transport a plurality of containers in a stacked state. For dispensing the goods contained therein, the closure member 5 can be opened and freely closed simply by breaking off the perforated lines 12, 12 previously made in the outer flaps 11, 11 of the outer container 13. Opening and closing of the closure member 5 becomes extremely easy because the ring 2 is reliably maintained in its fixed condition by the inner and outer flaps 10, 10, 11, 11, and additionally the ring 2 never shifts or is lowered even if the remaining amount of the goods is decreased. Thus, dispensing goods from the container is facilitated, and there can be offered a composite packing container which is simple in construction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A composite packing container comprising:

an inner container constructed of a synthetic resinous film and including a closed first end;

a ring having a central opening, said ring presenting a substantially flat upwardly facing surface and having a recessed portion on the inner edge thereof surrounding the opening, said ring further including a flange projecting downwardly therefrom;

a closure member detachably mounted in the opening and being disposed within said recessed portion of said ring when in a closed position;

a fastening ring clamp being mounted on an outer circumferential surface of said flange for retaining the closed first end of said inner container therebetween with said inner container forming a temporary closure for said opening in said ring;

an outer container including a box portion for receiving said inner container and a pair of opposing inner flaps connected to an upper peripheral edge of said box for being positioned within a gap formed between said ring and said inner container for supporting the ring and further including a pair of opposing outer flaps connected to the upper peripheral edge of said box for covering said closure member and said inner flaps, mutually facing inner surfaces of said inner and outer flaps being adhered together;

said outer flaps including a removable perforated area conforming to the shape of said closure member;

bottom flaps being connected to a lower peripheral edge of said box;

said inner container including a second end initially open after said first end is retained by said ring, closure member, fastening ring clamp and the inner and outer flaps of said box are affixed relative to each other;

said second end receiving a supply of material and thereafter being sealed;

said bottom flaps being adhered together to form a stackable container after said second end of said inner container is sealed.

2. The composite packing container according to claim 1, wherein the first closed end of the inner container adheres to the entire circumference of said flange so as to temporarily tightly close the opening of the ring.

3. The container according to claim 1, wherein the inner container forms a step portion on the periphery of said flange and said fastening ring clamp is arranged to be mounted on said step portion.

4. The container according to claim 1, wherein the ring and the closure member are made of a synthetic resinous material, said closure member including beads concentrically formed on a central plate area thereof.

5. The container according to claim 1, wherein the first closed end of said inner container is an expanded flat surface for engaging said ring.

6. The container according to claim 1, wherein the box is rectangular and the inner container is rectangular and formed from two sheets folded to form an envelope with overlapping right and left side portions being fused together in the form of a V in both end regions of a middle surface of the first closed end and said right and left side portions of the middle surface being turned inwardly and placed together with the respective opposite side edges of the opposite side surface portions as well as both side edges of the middle surface being fused together to form two sealed side edges of the inner container which when expanded forms a square first closed end.

7. The container according to claim 1, wherein the outer container is rectangular and the inner container is rectangular and is closed at a folded first closed end and includes opposite side edges heat sealed together and is expanded to produce a square first closed end with resultant triangular corner portions formed on opposite sides of the square first closed end being folded back on both the side edges of the inner container so as to form the rectangular container.

8. A container according to claim 1, wherein said inner flaps include semicircular areas for engaging said ring.

* * * * *